US005193716A

United States Patent [19]

Horiki et al.

[11] Patent Number: 5,193,716

[45] Date of Patent: Mar. 16, 1993

[54] MASKING METHOD

[75] Inventors: Seinosuke Horiki; Reiji Makino, both of Tokai, Japan

[73] Assignee: Nagoya Oilchemical Co., Ltd., Nagoya, Japan

[21] Appl. No.: 532,016

[22] Filed: Jun. 1, 1990

[30] Foreign Application Priority Data

Jun. 2, 1989 [JP] Japan ..... 1-64971[U]

[51] Int. Cl.[5] ..... B05D 1/32

[52] U.S. Cl. ..... 221/1; 221/279; 118/504; 118/505; 427/282; 427/300

[58] Field of Search ..... 118/504, 505; 221/279, 221/303, 312 R, 312 B, 312 C, 1; 427/282, 272, 300; 15/247

[56] References Cited

U.S. PATENT DOCUMENTS 2,445,026 7/1948 Frank ..... 221/279 X
3,565,664 2/1971 Al ..... 118/505 X
3,667,988 6/1972 Horiki ..... 118/504 X
3,998,238 12/1976 Nigro ..... 221/279 X
4,726,110 2/1988 Curtze ..... 427/282 X
4,873,126 10/1989 Bloomster et al. ..... 427/282
4,879,158 11/1989 Horiki et al. ..... 118/504 X
4,913,786 4/1990 Horiki et al. ..... 204/38.7

*Primary Examiner*—Richard L. Chiesa
*Attorney, Agent, or Firm*—Cooper & Dunham

[57] ABSTRACT

A masking method employing a masking tool to protect the hole(s) in an article such as a car body from a surface treatment is provided in the present invention. The masking member includes a cylinder having an inlet at one end and an outlet at the other end, a plural number of masking members having a plug shape respectively and being put in the cylinder to be placed one upon another, and a tranporting device arranged in the cylinder to transport the masking members successively from the inlet to the outlet of the cylinder to insert the masking members into the hole(s) of the article.

7 Claims, 2 Drawing Sheets

MASKING METHOD

BACKGROUND OF THE INVENTION

The present invention relates to a masking tool employed to protect the hole(s) in an article such as a car body from a surface treatment such as coating, plating, vacuum evaporation, phosphatizing, and the like.

Further, the present invention relates to a masking method employing said masking tool to protect said hole(s) of said article from said surface treatment.

More particularly, the present invention relates to a masking member which comprises a cylinder having an inlet at one end and an outlet at the other end, a plural number of masking members having a plug shape respectively and these being put in said cylinder to be placed one upon another, and a transporting means arranged in said cylinder to transport said masking members successively from the inlet to the outlet of said cylinder.

To protect the hole(s) of said article, said masking members in said cylinder of said masking tool are successively transported from the inlet to the outlet of said cylinder by said transporting means and said masking members are successively inserted in to said holes of said article before said surface treatment.

When a surface treatment is effected on the surface of an article, and if said article has hole(s) in which said surface treatment should not be effected, said hole(s) of said article should be protected by inserting a masking member(s) having a plug shape into said hole(s) before said surface treatment. In the case of the under side of a car body, said hole(s) may be water ejecting hole(s), shaft hole(s), harness hole(s) and the like, and a paint such as a polyvinylchloride-sol, a tarurethane mixture and the like is coated on said underside of said car body for corrosion, sound, and vibration proofing.

In a case of the surface treatment of the article having many holes, such as the coating of the under side of a car body as above described, many masking members should be inserted into said holes before said surface treatment. Further, in the case of a continuous mass-production line, said masking members should be inserted into said holes in a short time. Still further, in a case of a continuous mass-production line, it is desirable that said masking members be automatically inserted into said holes.

DESCRIPTION OF THE PRIOR ART

Hitherto, a masking member having a plugshape has been provided to protect the hole(s) in an article. Said masking member is made of a foamed plastic such as a foamed polystyrene and the like (U.S. Ser. No. 276,407, filed Nov. 23, 1988 and now U.S. Pat. No. 4,913,786).

Nevertheless, said masking member(s) is(are) inserted into said hole(s) of said article by hand and much labor and time have been necessary to protect said holes before said surface treatment.

SUMMARY OF THE INVENTION

Accordingly, an object of the present invention is to save labor and time in the case of a masking process before a surface treatment.

Another object of the present invention is to provide a masking method suitable for automatic operation.

A further object of the present invention is to provide a masking method suitable for a continuous mass-production line.

According to the present invention, there is provided a masking tool employed to protect the hole(s) of an article from a surface treatment, which comprises a cylinder having an inlet at one end and an outlet at the other end thereof, a plural number of masking members having a plug shape respectively and being put in said cylinder to be placed one upon another, and a transporting means arranged in said cylinder to transport said masking member from the inlet to the outlet of said cylinder and a masking method for the hole(s) of an article by employing said masking tool which comprises transporting said masking members in said cylinder from the inlet to the outlet thereof by said transporting means and inserting said masking members into hole(s) of an article one by one.

BRIEF DESCRIPTION OF THE DRAWINGS

FIG. 1 is a side sectional view of a masking tool.

FIG. 2 is a perspective view of a masking member.

FIG. 3 is a side sectional view of the hole of an article into which said masking member is inserted.

FIG. 4 is a side sectional view of the hole of an article after a coating.

DETAILED DESCRIPTION OF THE PREFERRED EMBODIMENTS

Figure 1:
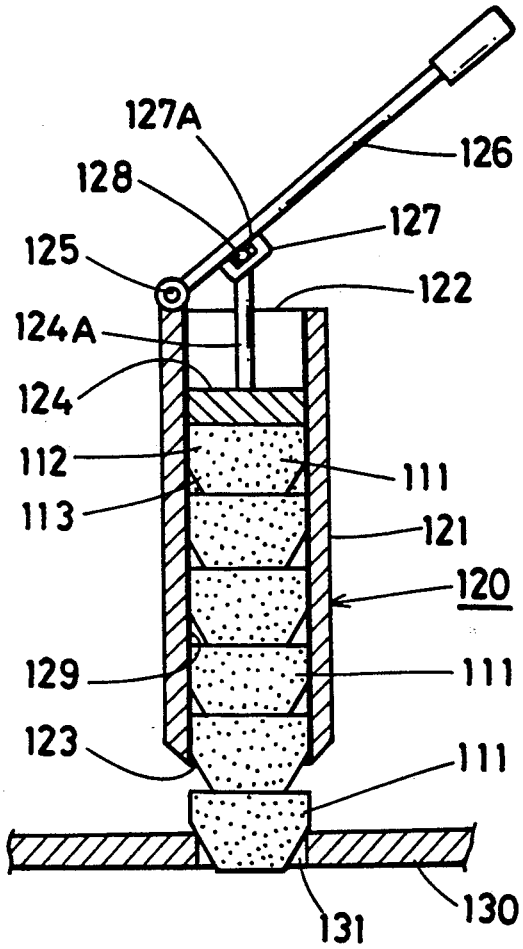
FIG. 1 to FIG. 4 relate to a first embodiment of the present invention.

FIG. 1 to FIG. 4 relate to a first embodiment of the present invention. Referring now to FIG. 1 to FIG. 4, a masking tool (120) comprises a cylinder (121) having an inlet (122) at one end and an outlet (123) at the other end, a friction sheet (129) attached to the inside of said cylinder (121), a plural number of masking members (111) put in said cylinder (121) to be placed one upon another, and a piston (124) as a transporting means. Said piston (124) is inserted into said cylinder (121) from said inlet (122) thereof and a handle (126) which is notably attached on said inlet (122) by an axis (125) is connected to the piston rod (124A) of said piston wherein a pin (128) of said piston rod (124A) is inserted in a groove (115A) of a bracket (127) of said handle (126).

Figure 2:
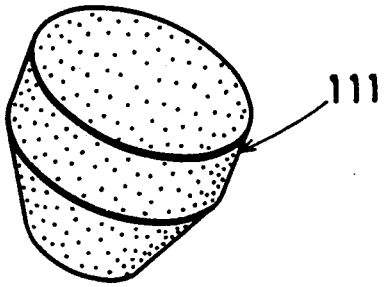

As shown in FIG. 2, each masking member (111) has a plug shape and is made of a material, such as of plastics or a rubber such as polystyrene, polyethylene, polypropylene, ethylene-propylene copolymer, polyvinylchloride, polyvinylidene chloride, polymethacrylate, styrene-butadiene copolymer acrylonitrile-butadiene copolymer, polybutadine polyisoprene, polyisobutylene, polychloroprene, isoprene-isobutylene copolymer, natural rubber, polyurethane, melamine resin, urea resin, phenol resin, epoxy resin and the like; foams of said plastics or said rubber; mixture of said plastics of said rubber with a filler such as a calcium carbonate, a talc, a bentonite, a fly ash, a blast furnace slag, and the like; a fiber material such as a thermoplastic resin—impregnated fiber a thermosetting risen—impregnated fiber; wooden material such as wood, hardboard, plywood and the like; metal material and the like; composite material consisting of a plural number of materials selected from the group of said materials.

A plural number of said masking members (111) are placed one upon another as above described and if desired, said masking members (111) be attached respectively by an adhesive or by melting.

Figure 3:
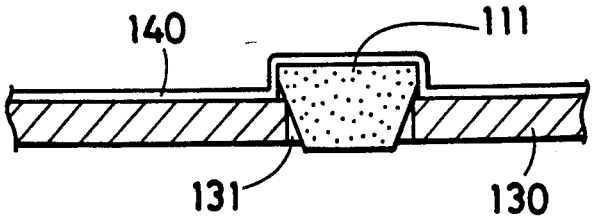
Figure 4:
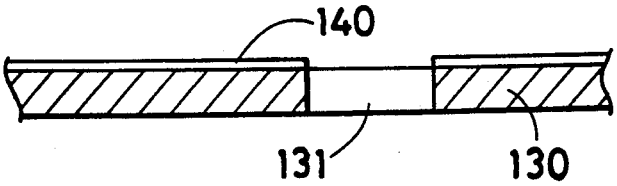

A plural number of said masking members (111) in said cylinder (121) of said masking tool (120) are successively transported from the inlet (122) to the outlet (123) by operation of said piston (124) by said handle (126) and said masking members (111) are inserted into holes (131) in an article (130) one by one as shown in FIG. 3, and after this, a paint such as a polyvinylchloridesol, an urethane resin, an asphalt, a rubber-asphalt mixture, a tar-urethane mixture and the like is coated on the surface of said article to form a coating layer (140) as shown in FIG. 3. After coating said masking member (111) is removed from said hole (131) and as shown in FIG. 4, said coating layer (140) is not formed on the inside of said hole (131).

If desired, said masking tool (120) is operated by a robot, and in this case, said masking members (111) are automatically inserted into said hole(s) (131) without the necessity of a laborer's hands.

Further, said piston (124) may be operated by a pressure oil cylinder, an electromagnetic cylinder, and the like instead of said handle (126).

Figure 5:
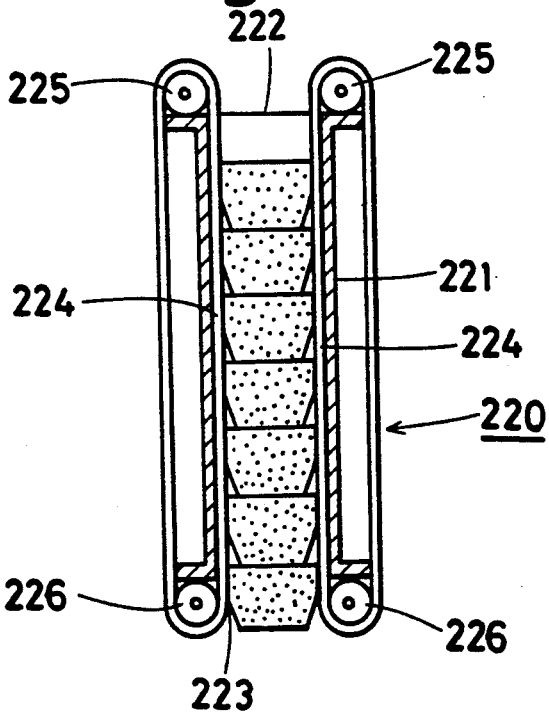
FIG. 5 relates to a second embodiment of the present invention and a side sectional view of a masking tool.

FIG. 5 relates to a second embodiment of the present invention. A masking tool (220) of this embodiment comprises a cylinder (221) having an inlet (222) at one end and an outlet (223) at the other end, a plural number of masking members (111) are put into said cylinder (221) to be placed one upon another, and a pair of endless belts (224), (224) act as a transporting means. Each of said endless belts (224), (224) is suspended on a pair of rollers (225), (226) wherein one set of said rollers (225), is rotatably attached to the inlet (222) of said cylinder (221) and the other set of said rollers (226) are rotatably attached to the outlet (223) of said cylinder (221). Said endless belts (224), (224) are respectively made of a friction material such as a rubber or cloth, having a flocking layer, and the like, and said masking members (111) are pressed between said pair of endless belts (224), (224) in said cylinder (221) of said masking tool (220).

A plural number of said masking members (111) are successively transported from the inlet (222) to the outlet (223) in said cylinder (221) by driving said rollers (225), (226) by a driving means such as a motor and the like to insert said masking members (111) into the hole(s) of an article one by one.

We claim:

1. A method for masking holes of an article comprising inserting into a cylinder having an inlet at one end and an outlet at the other end a separate friction material positioned and extending along the entire length of the inside of said cylinder and a plural number of plug shaped masking members placed one upon another within said cylinder so that they are supported by said friction material, and operating moving means positioned with respect to said cylinder to transport said masking members from the inlet to the outlet of said cylinder and moving said masking members from the outlet and inserting said masking members into the hole of an article to be masked.

2. A method of masking holes of an article employing a mask tool comprising a cylinder having an inlet at one end and an outlet at the outer end wherein a plural number of plug shaped masking members positioned for fitting into said holes are inserted in said cylinder placed one upon the other and wherein said masking members within said cylinder are supported by a separate friction material positioned and extending along the entire length of the inside of said cylinder and employing transporting means to move said masking member from the inlet to the outlet of said cylinder into the holes of the article to be masked.

3. A masking method in accordance with claim 2 wherein said employing transporting means comprises operating a piston arranged on the inlet of said cylinder.

4. A masking method in accordance with claim 3 comprising the step of operating said piston repeatedly to fit successive ones of said masking members into successive ones of said holes.

5. A masking method in accordance with claim 2 wherein said transporting means for moving said masking members comprises a pair of endless belts and said method comprises the steps of suspending each of said belts on a pair of rollers rotatably attached at respective ends of said cylinder and pressing said masking members between said pair of endless belts in said cylinder.

6. A masking method in accordance with claim 2 comprising the step of employing a robot to operate said masking tool.

7. A masking method in accordance with claim 2 wherein said transporting means comprises a pair of endless belts and said method comprises the step of suspending each of said belts on a separate pair of rollers.

* * * * *